US005647734A

United States Patent [19]

Milleron

[11] Patent Number: 5,647,734

[45] Date of Patent: Jul. 15, 1997

[54] HYDRAULIC COMBUSTION ACCUMULATOR

[76] Inventor: Norman Milleron, 1203 Spruce St., Berkeley, Calif. 94709

[21] Appl. No.: 486,201

[22] Filed: Jun. 7, 1995

[51] Int. Cl.[6] ..... F04B 17/05

[52] U.S. Cl. ..... 417/380; 60/595

[58] Field of Search ..... 417/380, 392, 417/364; 60/595; 123/46 R; 92/172

[56] References Cited

U.S. PATENT DOCUMENTS

| | | | |
|---|---|---|---|
| 3,119,230 | 1/1964 | Kosoff | 60/595 |
| 3,978,827 | 9/1976 | Wallis | 123/46 R |
| 3,986,796 | 10/1976 | Moiroux et al. | 417/380 |
| 3,991,574 | 11/1976 | Frazier | 417/318 |
| 4,426,916 | 1/1984 | Wimberly | 92/32 |
| 4,428,198 | 1/1984 | Sutter | 60/595 |
| 4,777,801 | 10/1988 | Porter | 417/380 |
| 4,974,498 | 12/1990 | Lemelson | 92/223 |
| 5,287,827 | 2/1994 | Almendinger | 123/46 R |

*Primary Examiner*—Timothy Thorpe
*Assistant Examiner*—Peter G. Korytnyk
*Attorney, Agent, or Firm*—Parkhurst, Wendel & Burr, L.L.P.

[57] ABSTRACT

A hydraulic combustion accumulator includes a cylinder divided into a combustion chamber and a hydraulic fluid chamber by a free reciprocating piston. An injection mechanism is provided for separately injecting a combustion fuel and air into the combustion chamber. The combustion fuel preferably includes at least one of ammonia and hydrogen. An ignition mechanism ignites the combustion gas in the combustion chamber thereby causing the piston to apply a pressurizing force to a hydraulic fluid contained in the hydraulic fluid chamber. A control unit controls the operation of the injection mechanism and ignition mechanism such that, in a preferred embodiment, multiple ignitions are achieved during a single combustion stroke of the piston. The hydraulic combustion accumulator can be utilized in a propulsion system as either a primary propulsion power source or a secondary propulsion power source.

16 Claims, 2 Drawing Sheets

HYDRAULIC COMBUSTION ACCUMULATOR

FIELD OF THE INVENTION

The invention relates in general to hydraulic accumulators. More specifically, the invention relates to a hydraulic combustion accumulator that is driven by non-polluting fuels including, for example, ammonia and/or hydrogen gas.

BACKGROUND OF THE INVENTION

The requirements of government imposed air quality standards have driven the need for developing alternative propulsion systems for automobiles other than the convention internal combustion engine. A highly desired alternative propulsion system is the use of electricity as a primary propulsion power source, due to the essentially non-polluting nature of electric propulsion systems. Electric propulsion systems for vehicles that utilize either batteries or fuel cells have been proposed for automobiles, but have not found practical implementation due to a number of deficiencies. Fuels cells are generally too expensive to incorporate into a commercially viable vehicle available on a mass produced basis. Battery powered systems, in particular, suffer from a lack of sufficient range and power. In order to overcome these deficiencies, propulsion systems have been proposed in which a secondary propulsion power source is provided to boost performance during peak demand periods. Such peak demand periods may occur, for example, when the vehicle is traversing a steep grade or entering high speed traffic. A small internal combustion engine could be utilized as a secondary propulsion power sou to either drive a generator to producing additional electricity or to directly drive the vehicle during peak demand periods, but would not be desirable as it produces polluting combustion by-products which is contrary to the initial reason for utilizing electric propulsion, namely, to provide a pollution free propulsion source.

In view of the above, it is an object of the invention to provide a device that can be readily incorporated into a non-polluting propulsion system as either a primary propulsion power source or a secondary propulsion source.

SUMMARY OF THE INVENTION

The object of the invention is achieved by the use of a hydraulic combustion accumulator that includes a cylinder divided into a combustion chamber and a hydraulic fluid chamber by a free reciprocating piston. An injection mechanism is provided for injecting a combustion gas and air into the combustion chamber. The combustion gas preferably includes at least one of ammonia and hydrogen. An ignition mechanism ignites the combustion gas in the combustion chamber thereby causing the piston to apply a pressurizing force to a hydraulic fluid contained in the hydraulic fluid chamber. A control unit controls the operation of the injection mechanism and ignition mechanism such that, in a preferred embodiment, multiple combustion operations are achieved during a single combustion stroke of the piston.

BRIEF DESCRIPTION OF THE DRAWINGS

The invention will be described in greater detail with reference to the accompanying drawings, wherein.

DETAILED DESCRIPTION OF THE PREFERRED EMBODIMENTS

Figure 1:
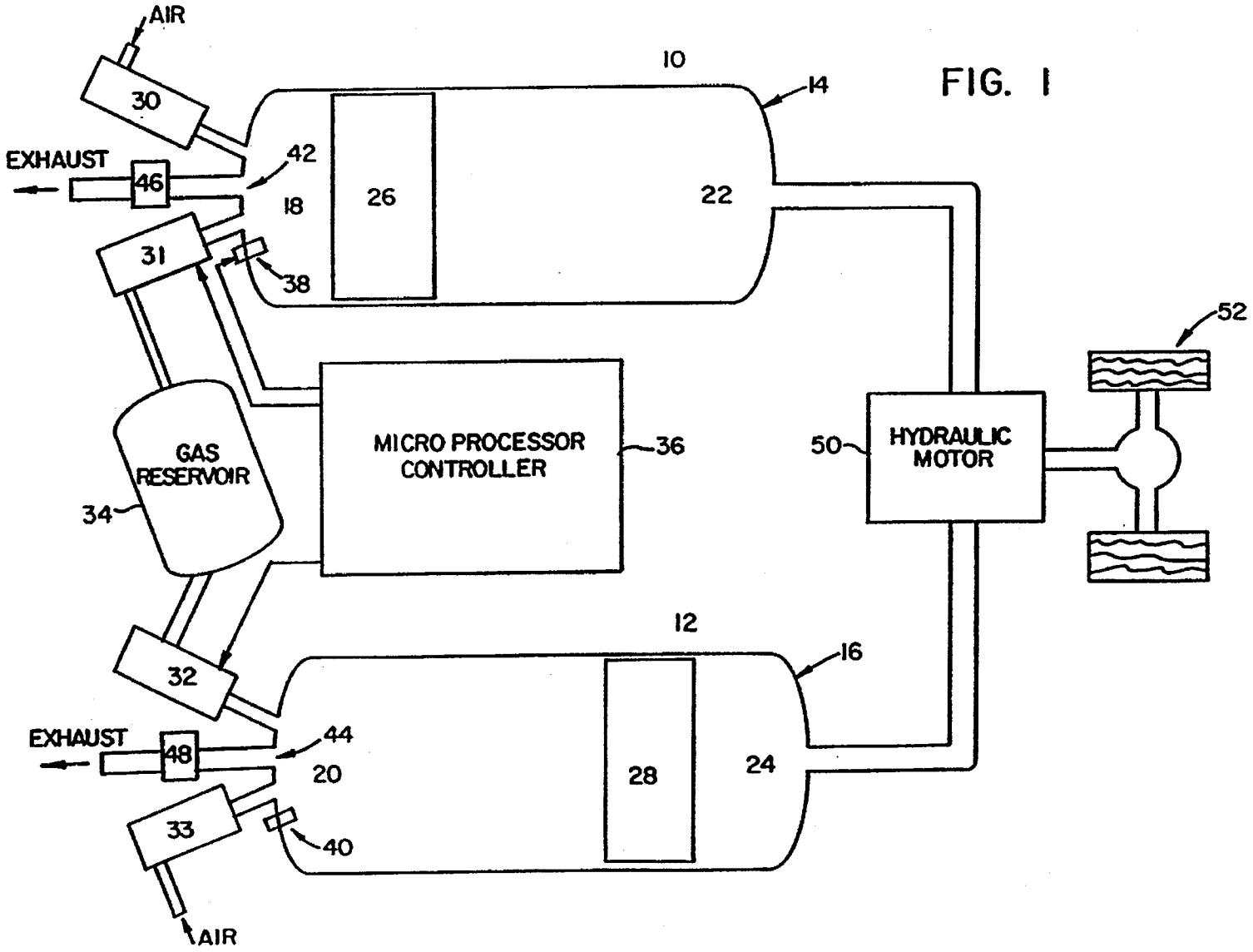
FIG. 1 illustrates a propulsion system incorporating hydraulic combustion accumulators in accordance with the invention.

A propulsion system incorporating first and second hydraulic combustion accumulators 10, 12 in accordance with the present invention is illustrated in FIG. 1. The hydraulic combustion accumulators 10, 12 each include a cylinder 14, 16 divided into a combustion chamber 18, 20 and a hydraulic chamber 22, 24 by a free reciprocating piston 26, 28. Injectors 30–33 are provided to inject a combustion gas contained in a combustion gas reservoir 34 and air into the combustion chambers 18, 20 of the hydraulic combustion accumulators 10, 12 under control of a microprocessor controller 36. The combustion gas is preferably hydrogen, ammonia or ammonia with dissolved hydrogen stored at a pressure of 250 p.s.i., although other fuels, gases, combination of gases and storage pressures may be readily utilized. Piezoelectric ignitors 38, 40 are provided in the combustion chambers 18, 20 to ignite the combustion gas/air mixture under control of the microprocessor controller 36. Each of the combustion chambers 18, 20 is also provided with an exhaust port 42, 44 including an exhaust valve 46, 48 that is controlled by the microprocessor controller 36. The hydraulic chambers 22, 24 are coupled to a hydraulic motor 50 in a closed loop hydraulic system, such that the hydraulic combustion accumulators 10, 12 work in opposition, namely, when the first hydraulic combustion accumulator 10 is in a compression stroke the second hydraulic combustion accumulator 12 is in an exhaust stroke. Although not illustrated, the hydraulic system may also include additional pressurized fluid reservoirs or accumulators if desired.

The hydraulic fluid contained in the hydraulic chambers 22, 24 is preferably pressurized to at least 6,000 p.s.i. to drive the hydraulic motor 50, although other pressures may be readily employed depending on the requirements of the hydraulic motor. In order to properly inject air and combustion gas into the combustion chambers 18, 20 at the desired operating pressures, it is further desirable that the injectors 30–33 produce injection pressures of about 45,000 p.s.i. for the combustion gas and air. Although not specifically illustrated, the injectors 30–33 are preferably combustion driven injectors that utilize rotary or poppet valves controlled by the microprocessor controller 36 to inject small amounts of the combustion gas and air into an injector combustion chamber. The combined combustion gas and air mixture in the injector combustion chamber is ignited by a piezoelectric ignitor, also under control the microprocessor controller 36, and the resulting combustion is used to drive a main charge of combustion gas and air into the combustion chambers 18, 20 of the hydraulic combustion accumulators 10, 12. Although combustion driven injectors are preferred, any type of injector that generates sufficient pressure for the selected operating pressures of the hydraulic combustion accumulators 10, 12 may be employed.

Figure 2:
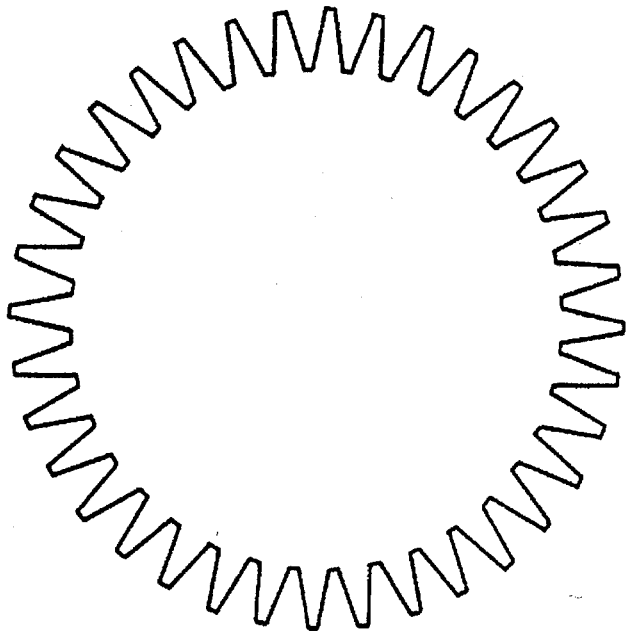
FIG. 2 illustrates radial cuts formed in a plate utilized in the construction of the pistons illustrated in FIG. 1.
Figure 3:
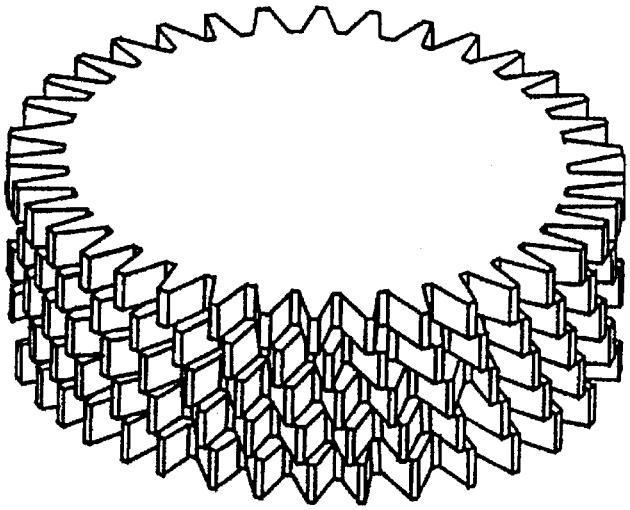
FIG. 3 illustrates a plurality of stacked plates having radial cuts utilized as a piston in the present invention.

In the illustrated preferred embodiment, the cylinders 14, 16 have an internal diameter of at least six inches and are formed preferably from a carbon steel or alloy metal tube reinforced with a wrapping of steel wire or glass fiber. The thickness of the cylinders 14, 16 is minimized, preferably to about 0.10 inches, to reduce the weight of the hydraulic combustion accumulators 10, 12. Due to the high pressures employed, the thin walls of the cylinders 10, 12 will tend to flex to a barrel shape. It is therefore desirable that the pistons 26, 28 be capable of flexibly conforming to match the shape of the flexed cylinders. Accordingly, the pistons 26, 28 are preferably formed from multiple layers of stainless steel or plated steel having equally spaced radial cuts formed around their circumference as shown in FIG. 2. The individual layers are stacked so that the radial cuts between layers are offset with one another to impede fluid flow, i.e., the face of the pistons 26, 28 essentially appear as solid surfaces to the hydraulic fluid, as shown in FIG. 3. The radial cuts permit the pistons 26, 28 to readily conform to the shape of the cylinders 14, 16.

The pistons 26, 28 are lubricated by water that is formed during the combustion process in the combustion chambers 18, 20 and by the hydraulic fluid contained in the hydraulic chambers 22, 24. It should be noted that the hydraulic fluid is preferably water or water based, as surfaces of the cylinders 14, 16 subject to combustion will be coated by layers of the hydraulic fluid due to the movement of the pistons 26, 28. Mineral based hydraulic fluids are flammable, and would therefore interact with the combustion of the combustion gas and generate polluting by-products, whereas water based hydraulic fluid would be essentially non-polluting. While water or water based hydraulic fluid would normally increase friction and wear as opposed to mineral based hydraulic fluid, thereby reducing the efficiency of the system, this problem can be addressed and overcome by coating the interior surfaces of the cylinders and/or the outer surfaces of the pistons 26, 28 with a layer of diamond. In order to have diamond stick to the steel pistons or cylinders, a precursor material such as molybdenum must be coated on the steel.

The operation of the system illustrated in FIG. 1 will now be described in greater detail. As is illustrated in FIG. 1, the first hydraulic combustion accumulator 10 is ready to begin a combustion stroke and the second hydraulic combustion accumulator 12 is ready to begin an exhaust stroke. The microprocessor controller 36 controls the operation of exhaust ports 42, 44 to close the exhaust valve 46 coupled to first hydraulic combustion accumulator 10 and to open the exhaust valve 48 coupled to the second hydraulic combustion accumulator 12. The combustion gas injector 31 and the air injector 30 are then activated by the microprocessor controller 36 to inject the proper mixture of combustion gas and air into the combustion chamber 18 of the first hydraulic combustion accumulator 10. The microprocessor controller 36 then activates the ignitor 38 in the combustion chamber 18 of hydraulic combustion accumulator 10 to ignite the gas/air mixture contained therein. The resulting combustion applies a force to the piston 26 that causes the piston 26 to move and apply a pressurizing force to the hydraulic fluid contained in the hydraulic chamber 22. The pressurized hydraulic fluid flows to the hydraulic motor 50 and back to the hydraulic fluid chamber 24 of the second hydraulic combustion accumulator 12 through the closed loop hydraulic system, causing the piston 28 of the second hydraulic combustion accumulator 12 to be displaced toward the combustion chamber 20 thereof, and exhausting any combustion by-products contained in the combustion chamber 20 through the exhaust port 44. Once the combustion stroke of the first hydraulic combustion accumulator 10 is completed, the microprocessor controller 36 closes the exhaust valve 48 of the second hydraulic combustion accumulator 12, opens the exhaust valve 46 of the first hydraulic combustion accumulator 10, and controls the operation of the injectors 32, 33 to charge the combustion chamber 22 of the second hydraulic combustion accumulator 12. The ignitor 40 in the combustion chamber 22 is then activated by the microprocessor controller 36 to begin the combustion stroke of the second hydraulic combustion accumulator 12 and the exhaust stroke of the first hydraulic combustion accumulator 10.

It should be noted that the combustion stroke can consist of a single injection and ignition of gas as generally described above. It is preferably, however, to form the combustion stroke of a series of combustion pulses caused by multiple injections and ignitions of combustion gas to smooth the pressurization of the hydraulic fluid and to maximize the resulting efficiency of the system. Accordingly, the microprocessor controller 36 controls the operation of the injectors 30–34 and ignitors 38, 40 to cause multiple ignitions within a single combustion stroke, with each full combustion stroke taking a minimum of about one second.

The motor 50 is used to either directly drive the wheels 52 of a vehicle as a direct primary propulsion source or as a direct secondary propulsion source that is used to provide reserve power to a primary propulsion source, for example electrical, when entering high speed traffic, climbing hills or in other situations requiring additional power. Alternatively, the motor 50 can be utilized to drive a generator and produce electrical energy which is then supplied to an electrical propulsion system. In either case, the result is an essentially pollution free propulsion system having sufficient power to overcome the deficiencies of conventional alternative propulsion sources. It is believed that the hydraulic combustion accumulators of the present invention could readily produce more than 150 H.P. peak, within weight, space and expense limitations that would lend application to mass production for the consumer market.

The invention has been described with reference to certain preferred embodiments thereof. It will be understood, however, that modifications and variations are possible within the scope of the appended claims.

It should be noted that the combustion stroke can consist of a single injection and ignition of gas as generally described above. It is preferably, however, to form the combustion stroke of a series of combustion pulses caused by multiple injections and ignitions of combustion gas to smooth the pressurization of the hydraulic fluid and to maximize the resulting efficiency of the system. Accordingly, the microprocessor controller 36 controls the operation of the injectors 30–34 and ignitors 38, 40 to cause multiple ignitions within a single combustion stroke, with each full combustion stroke taking a minimum of about one second.

The motor 50 is used to either directly drive the wheels 52 of a vehicle as a direct primary propulsion source or as a direct secondary propulsion source that is used to provide reserve power to a primary propulsion source, for example electrical, when entering high speed traffic, climbing hills or in other situations requiring additional power. Alternatively, the motor 50 can be utilized to drive a generator and produce electrical energy which is then supplied to an electrical propulsion system. In either case, the result is an essentially pollution free propulsion system having sufficient power to overcome the deficiencies of conventional alternative propulsion sources. It is believed that the hydraulic combustion accumulators of the present invention could readily produce more than 150 H.P. peak, within weight, space and expense limitations that would lend application to mass production for the consumer market.

The invention has been described with reference to certain preferred embodiments thereof. It will be understood, however, that modifications and variations are possible within the scope of the appended claims. For example, although the hydraulic combustion accumulators have been described with reference to propulsion systems, they can be readily incorporated into a variety of different systems. In such cases, weight reduction may not be a factor and conventional thick walled cylinders with conventional piston structures may be utilized in cooperation with the other novel aspects of the invention.

What is claimed is:

1. A propulsion system incorporating first and second hydraulic combustion accumulators comprising:

at least two cylinders connected in a closed system each of said cylinders containing a hydraulic fluid and being divided by a freely reciprocating piston into a combustion chamber and a hydraulic fluid chamber; injection means for injecting a combustion gas into the combustion chamber; ignition means for igniting combustion gas in the combustion chamber thereby applying a pressurizing force to the hydraulic fluid contained in the hydraulic fluid chamber; and control means for controlling the operation of the injection means and the ignition means, wherein the respective hydraulic fluid chambers of each of said at least two cylinders are connected to each other, and the pistons in said at least two cylinders are located such that they are out of phase with each other.

2. A hydraulic combustion accumulator as claimed in claim 1, wherein the control means controls the operation of the injection means and the ignition means to generate multiple ignitions during a single combustion stroke of the piston.

3. A hydraulic combustion accumulator as claimed in claim 1, wherein an interior surface of the cylinder and the piston are coated with diamond.

4. A hydraulic combustion accumulator as claimed in claim 1, wherein the hydraulic fluid is selected from the group consisting of water and a water based hydraulic fluid.

5. A hydraulic combustion accumulator as claimed in claim 1, wherein the piston comprises a stacked plurality of sheets of rigid material whose circumferential portions are capable of flexibly conforming to match the shape of the interior surface of the cylinder therewith.

6. A hydraulic combustion accumulator as claimed in claim 5, wherein said sheets comprise a material selected from the group consisting of stainless steel, plated steel, and molybdenum coated steel.

7. A hydraulic combustion accumulator as claimed in claim 5, wherein the sheets are stacked so that the radial cuts are offset.

8. A hydraulic combustion accumulator as claimed in claim 1, wherein the injection means includes a combustion driven injector.

9. A hydraulic combustion accumulator comprising:

a cylinder containing hydraulic fluid and divided by a freely reciprocating piston into a combustion chamber and a hydraulic fluid chamber said piston having radial cuts so that said piston impedes but does not fully prevent passage of hydraulic fluid past said piston from the hydraulic fluid chamber to the combustion chamber; injection means for injecting a combustion gas into the combustion chamber; ignition means for igniting combustion gas in the combustion chamber thereby applying a pressurizing force to the hydraulic fluid contained in the hydraulic fluid chamber; and control means for controlling the operation of the injection means and the ignition means.

10. A hydraulic combustion accumulator as claimed in claim 9, wherein the control means controls the operation of the injection means and the ignition means to generate multiple ignitions during a single combustion stroke of the piston.

11. A hydraulic combustion accumulator as claimed in claim 9, wherein an interior surface of the cylinder and the piston are coated with diamond.

12. A hydraulic combustion accumulator as claimed in claim 9, wherein the hydraulic fluid is selected from the group consisting of water and a water based hydraulic fluid.

13. A hydraulic combustion accumulator as claimed in claim 9, wherein the piston comprises a stacked plurality of sheets of rigid material whose circumferential portions are capable of flexibly conforming to match the shape of the interior surface of the cylinder therewith.

14. A hydraulic combustion accumulator as claimed in claim 13, wherein the sheets are stacked so that the radial cuts are offset.

15. A hydraulic combustion accumulator as claimed in claim 13, wherein said sheets comprise a material selected from the group consisting of stainless steel, plated steel, and molybdenum coated steel.

16. A hydraulic combustion accumulator as claimed in claim 9, wherein the injection means includes a combustion driven injector.

* * * * *